US012179259B2

(12) United States Patent
Pezzoli

(10) Patent No.: US 12,179,259 B2
(45) Date of Patent: Dec. 31, 2024

(54) DIE-CASTING MACHINE WITH ENERGY SAVING EVALUATION

(71) Applicant: ITALPRESSEGAUSS S.P.A., Brescia (IT)

(72) Inventor: Andrea Pezzoli, Brescia (IT)

(73) Assignee: ITALPRESSEGAUSS S.P.A., Brescia (IT)

( * ) Notice: Subject to any disclaimer, the term of this patent is extended or adjusted under 35 U.S.C. 154(b) by 80 days.

(21) Appl. No.: 17/973,192

(22) Filed: Oct. 25, 2022

(65) Prior Publication Data

US 2023/0043574 A1 Feb. 9, 2023

Related U.S. Application Data

(63) Continuation of application No. 16/610,068, filed as application No. PCT/IB2018/054461 on Jun. 18, 2018, now abandoned.

(30) Foreign Application Priority Data

Jun. 19, 2017 (IT) ..... 102017000067908

(51) Int. Cl.
*B22D 17/32* (2006.01)
*B22D 17/10* (2006.01)
*B22D 17/26* (2006.01)

(52) U.S. Cl.
CPC ..... *B22D 17/32* (2013.01); *B22D 17/10* (2013.01); *B22D 17/266* (2013.01)

(58) Field of Classification Search
CPC .. B22D 17/20; B22D 17/2015; B22D 17/266; B22D 17/32
See application file for complete search history.

(56) References Cited

U.S. PATENT DOCUMENTS 4,904,913 A 2/1990 Jones et al.
5,486,106 A 1/1996 Hehl
6,280,170 B1 8/2001 Furuya et al.
(Continued)

FOREIGN PATENT DOCUMENTS

CN 1294968 A 5/2001
CN 201956967 U 8/2011
(Continued)

OTHER PUBLICATIONS

Machine Translation of Kano (JP 2001-004677 A, Jan. 12, 2001, cited in IDS filed Jan. 28, 2022). (Year 2001).
(Continued)

*Primary Examiner* — Kevin E Yoon
*Assistant Examiner* — Jacky Yuen
(74) *Attorney, Agent, or Firm* — Polsinelli PC

(57) ABSTRACT

The present technology includes a hydraulic die-casting machine with electric motor actuated by an inverter, which provides an energy saving evaluation system with respect to a die-casting machine without inverter. The hydraulic die-casting machine includes an injection assembly provided with an injection piston for pressurizing case metal poured into a die and a hydraulic circuit for actuating the injection piston, a hydraulic pump for feeding the hydraulic circuit through a delivery line, an electric motor for actuating the hydraulic pump and an inverter for actuating the electric motor, and an evaluation system for evaluation of the energy savings provided by the present technology.

13 Claims, 5 Drawing Sheets

(56) References Cited

U.S. PATENT DOCUMENTS

| | | | |
|---|---|---|---|
| 7,043,377 | B2 | 5/2006 | Shiraishi |
| 8,078,327 | B2 | 12/2011 | Lu et al. |
| 2003/0037545 | A1 | 2/2003 | Schienbein et al. |
| 2005/0154543 | A1 | 7/2005 | Shiraishi |
| 2007/0054007 | A1 | 3/2007 | Yamaura et al. |
| 2011/0054828 | A1 | 3/2011 | Junk |

FOREIGN PATENT DOCUMENTS

| | | | |
|---|---|---|---|
| CN | 204488001 | U | 7/2015 |
| JP | H02-211967 | A | 8/1990 |
| JP | H05-84799 | A | 4/1993 |
| JP | H07-96541 | A | 4/1995 |
| JP | H07-167106 | A | 7/1995 |
| JP | 2000-052392 | A | 2/2000 |
| JP | 2001-004677 | A | 1/2001 |
| JP | 2001-280257 | A | 10/2001 |
| JP | 2005-169807 | A | 6/2005 |
| JP | 2005-297481 | A | 10/2005 |
| JP | 2009-226449 | A | 10/2009 |
| JP | 2013-006193 | A | 1/2013 |
| JP | 2015-077725 | A | 4/2015 |
| JP | 2015-112864 | A | 6/2015 |
| JP | 2016-087638 | A | 5/2016 |
| WO | 2005/002035 | A1 | 1/2005 |

OTHER PUBLICATIONS

Frech, eFacts—Energy Efficiency: A Critical Success Factor, Jun. 2015, <https://www.frech.com/downloads.html?file=files/frech/Documents/Downloads/eFACTS_en.pdf> (Year: 2015).

Translated: Research and validation of the injection molding machine and energy saving model based on the energy saving rate forecasting, Jan. 1, 2017, 14 total pages with English translation, J.issn. 1009-1831.2017.01.009, vol. 19, No. 1, sgdsm.cnjournals.com, China.

International Search Report and Written Opinion, dated Sep. 26, 2018, for the corresponding International Application No. PCT/IB2018/054461, in 9 pages.

DIE-CASTING MACHINE WITH ENERGY SAVING EVALUATION

CROSS-REFERENCES TO RELATED PATENT APPLICATIONS

This patent application is a continuation of U.S. patent application Ser. No. 16/610,068, entitled "DIE-CASTING MACHINE WITH ENERGY SAVING EVALUATION SYSTEM," filed on Oct. 31, 2019, which is a national phase of PCT/IB2018/054461, entitled "DIE-CASTING MACHINE WITH ENERGY SAVING EVALUATION SYSTEM," filed on Jun. 18, 2018, which claims priority of IT 102017000067908, entitled "DIE-CASTING MACHINE WITH ENERGY SAVING EVALUATION SYSTEM," filed on Jun. 19, 2017, each of the foregoing applications is incorporated herein by reference in its entirety.

FIELD OF THE INVENTION

The present invention relates to a hydraulically actuated die-casting machine, in particular for the die-casting of light alloys. In particular, the object of the present invention is a die-casting machine equipped with an inverter for actuating the electric motor which actuates a hydraulic pump, provided with an energy saving evaluation system.

BACKGROUND OF THE INVENTION

As is known, such machines operate on a die consisting of two die-halves coupling to form the cavity corresponding to the piece to be made and consist of a die closing assembly and an injection assembly provided with an injection piston to pressurize the molten metal poured into the die.

For actuating the injection assembly and the closing assembly, as well as for further process management activities, a hydraulic circuit is provided which is regulated by numerous valves and fed by a hydraulic pump.

Some solutions provide for the hydraulic pump to be actuated by an electric motor that is simply connected to the electrical grid, while others provide for an electric motor actuated by an inverter, which guarantees considerable energy savings depending on the parameters of the processing to be carried out and other advantages, which will be discussed later.

However, normally, in a manufacturing company where many die-casting machines are installed for making various semi-finished products, not all the machines provide for being actuated by inverter.

In such condition, the need of the manufacturing company to optimize the use of the available machinery, especially to optimize energy consumption, is very much felt. However, at present, the choice of carrying out some processing operations on machines without inverters rather than on machines with inverters is entrusted to the experience of the technical staff.

SCOPE OF THE INVENTION

The object of the present invention is to provide a die-casting machine with inverter equipped with a system for evaluating the energy savings achieved in carrying out a processing operation compared to the use of a machine without inverter.

Such object is achieved by a die-casting machine with inverter, comprising:

an injection assembly provided with an injection piston for pressurizing cast metal poured into a die and a hydraulic circuit for actuating the injection piston;

a hydraulic pump for feeding the hydraulic circuit through a delivery line;

an electric motor for actuating the hydraulic pump and an inverter for actuating the electric motor;

an evaluation system of the energy savings with respect to a die-casting machine without inverter, comprising:

a) a delivery pressure sensor suitable to detect the pump delivery pressure over a time interval;

b) a consumption detection device for detecting the real energy consumption of the inverter for the time interval;

c) a storage device wherein the data relating to the power absorbed by an electric motor without inverter for a delivery pressure are stored;

d) a processing device suitable to obtain the delivery pressure from the delivery pressure sensor and the absorbed power of a predefined electric motor without an inverter for the predefined delivery pressure from the storage device to calculate an estimated energy consumption over the time interval;

e) a display device for the representation of data acquired by the processing device.

DETAILED DESCRIPTION OF A PREFERRED EMBODIMENT

According to an embodiment of the invention, a die-casting machine 1 comprises a closing assembly 500 for closing die-halves carried by die-holders 502, 504 and an injection assembly 10 comprising an injection piston for pressurizing the molten metal poured into a die formed by the coupling of the die-halves.

Figure 1:
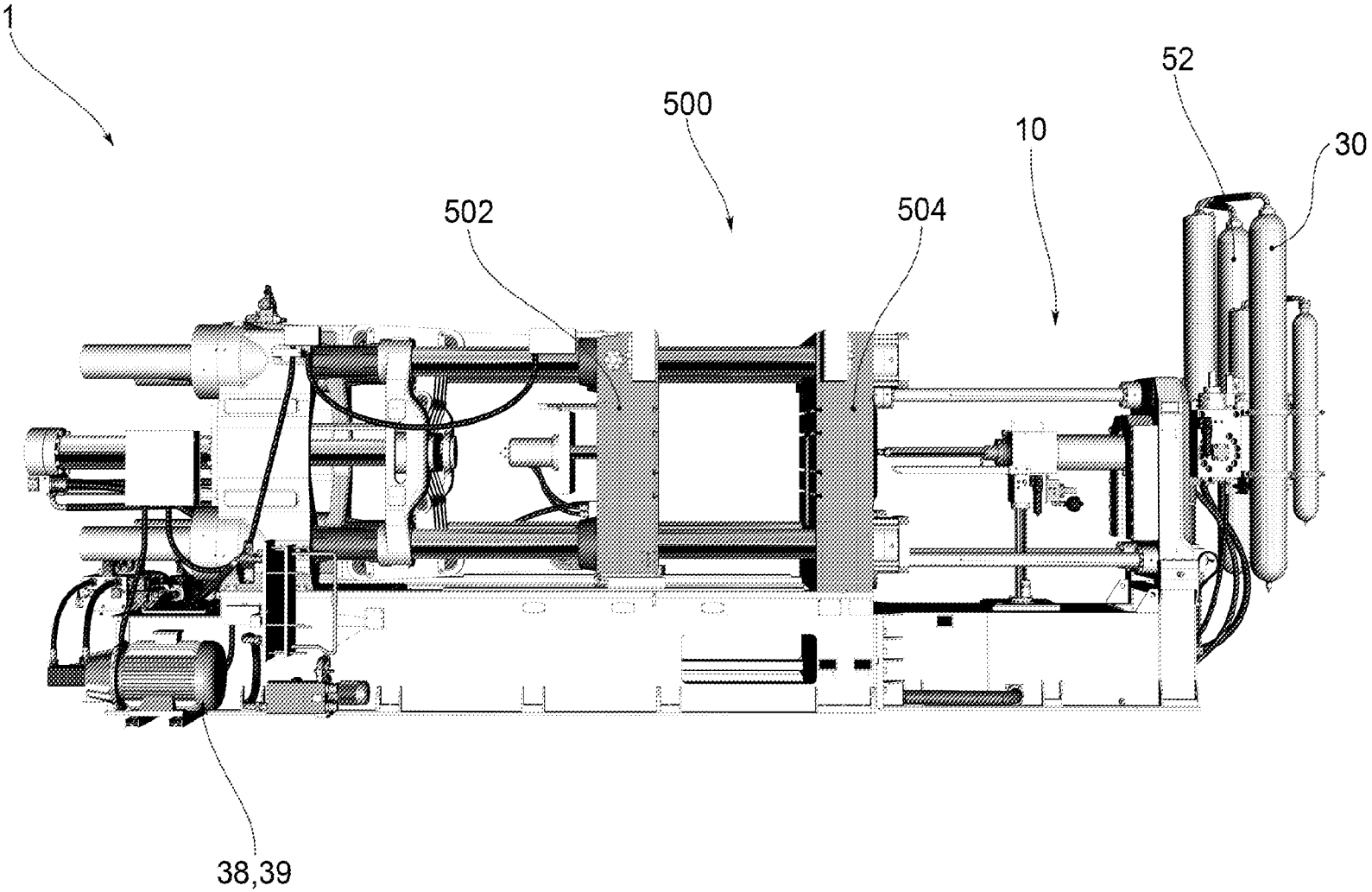
FIG. 1 schematically illustrates a die-casting machine according to an embodiment of the present invention.
Figure 2:
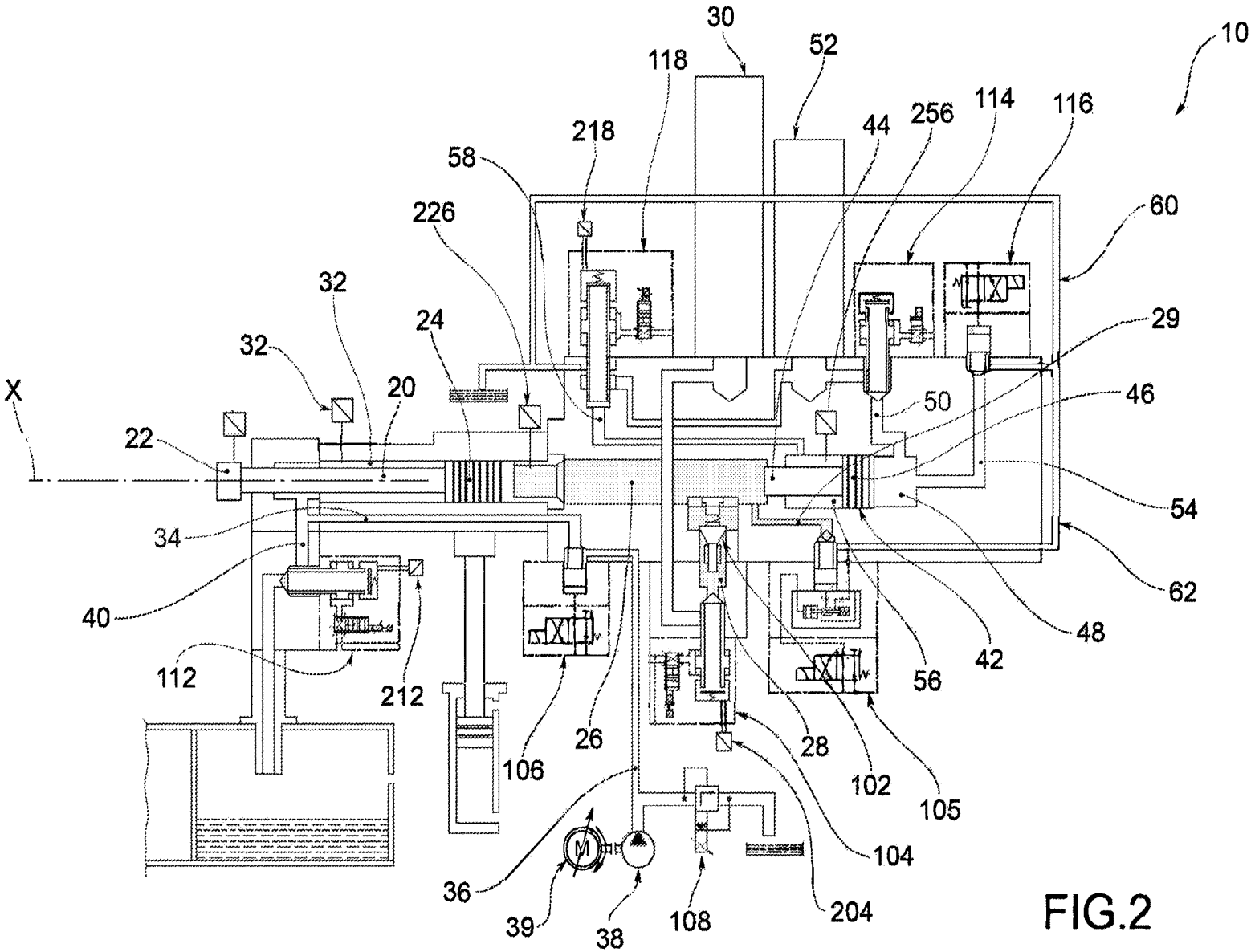
FIG. 2 illustrates a diagram of an injection assembly of the die-casting machine of FIG. 1.
Figure 3:
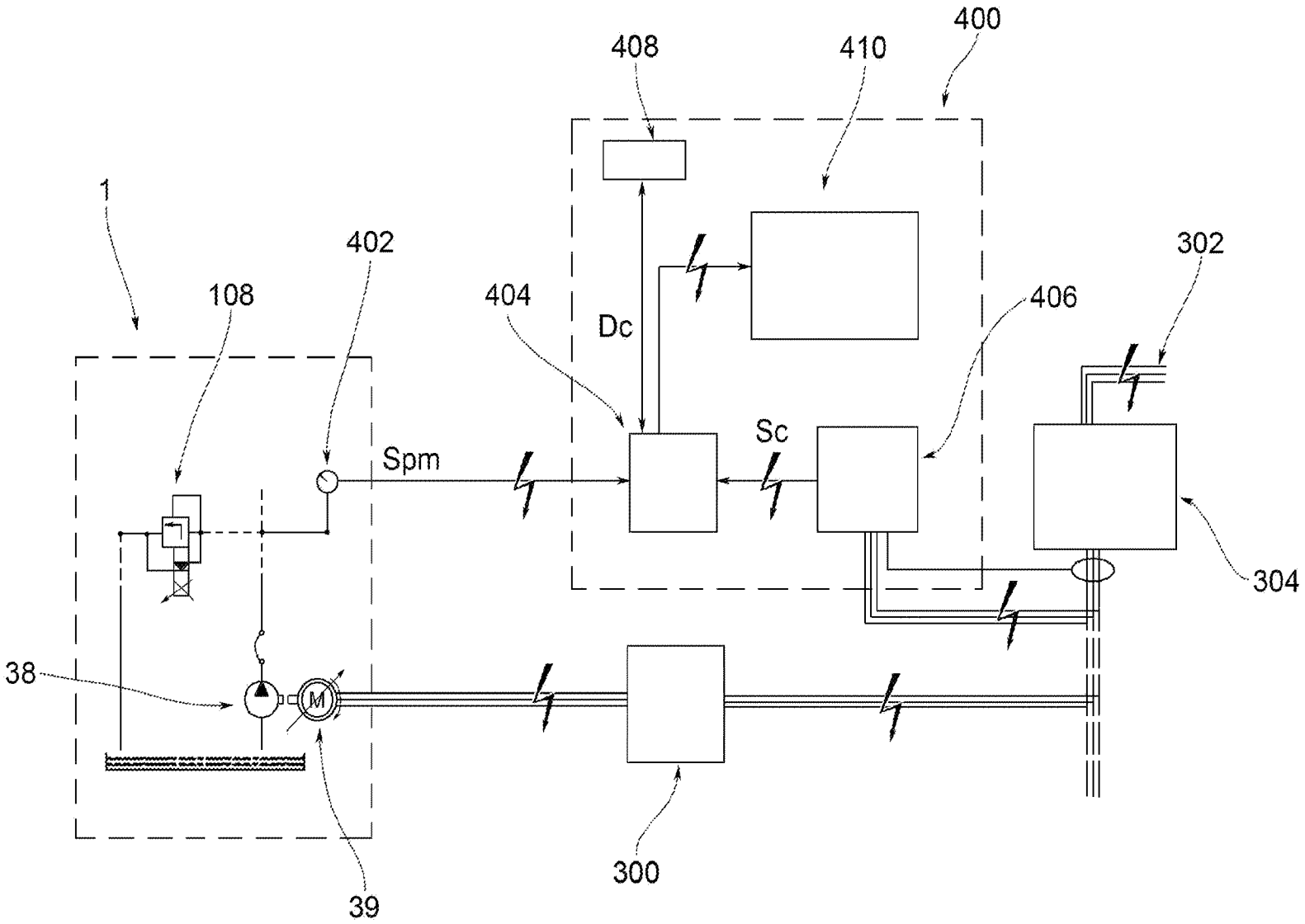
FIG. 3 shows a diagram of an energy saving evaluation system according to an embodiment of the present invention.
Figure 4:
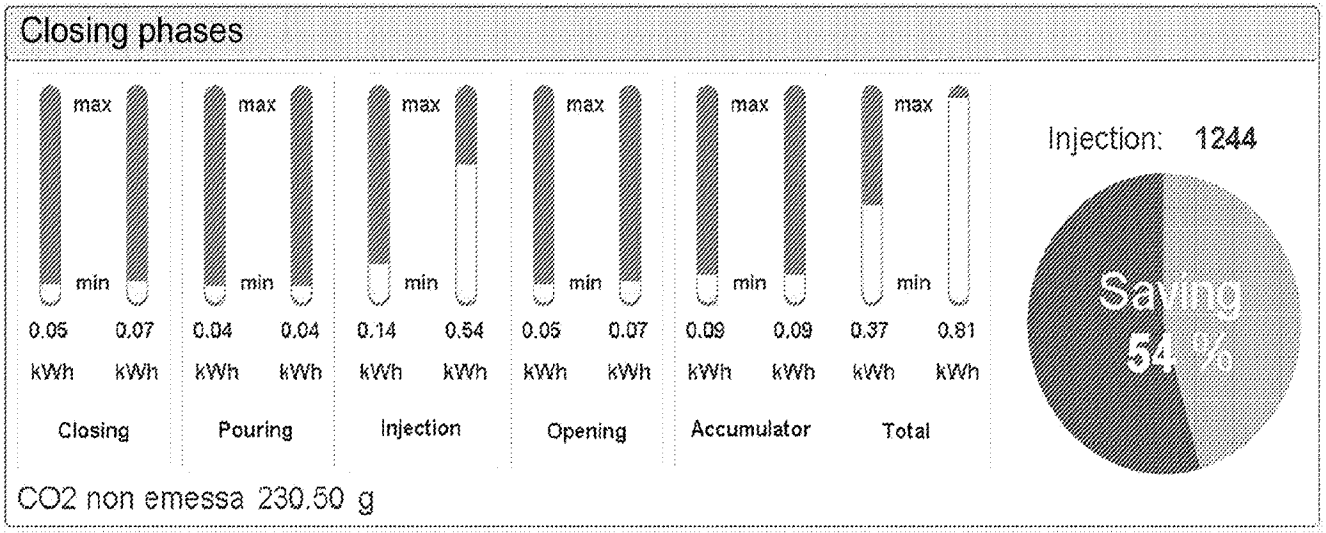
FIG. 4 represents a graphical interface for displaying characteristic data provided by the evaluation system.
Figure 4:
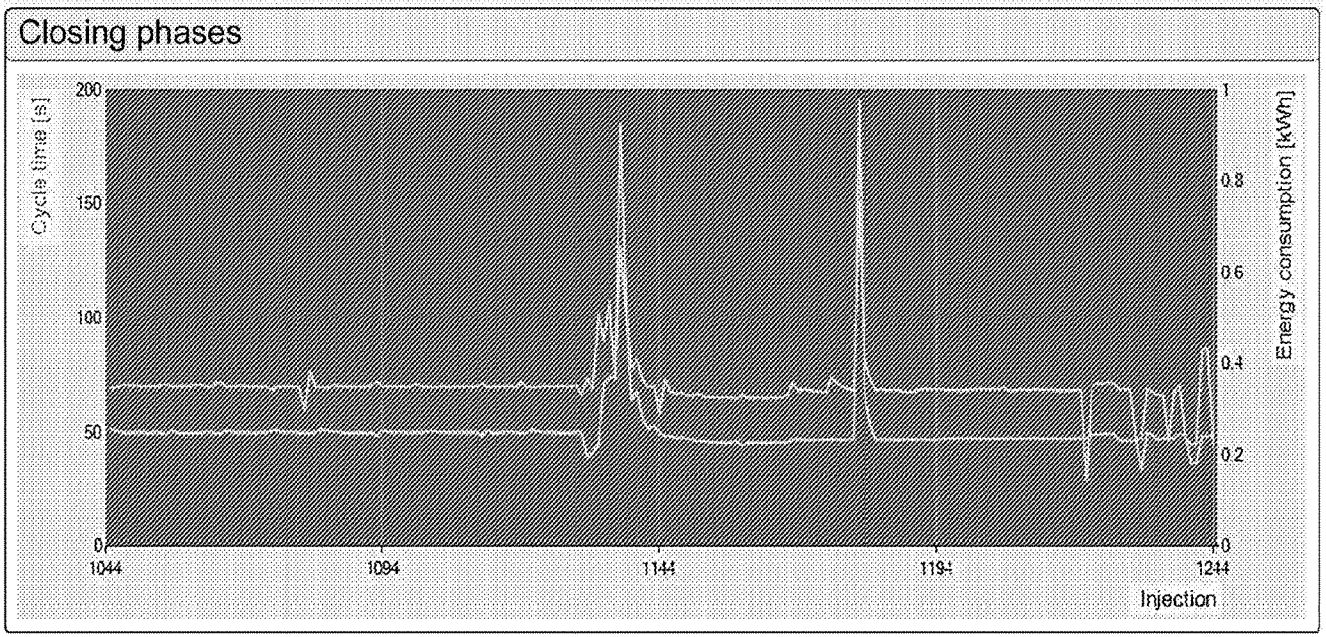

By way of example, a preferred embodiment of the injection assembly will be described hereinafter (FIG. 2).

The injection assembly 10 comprises an injection piston 20, which extends along a translation axis X between a head end 22 and an opposite tail end 24. The injection piston 20 is translatable on command along the translation axis X by means of a hydraulic drive.

The injection assembly 10 also has a main pressure chamber 26, upstream of the injection piston 20, i.e. upstream of the tail end 24 thereof, for containing and pressurizing the fluid intended for the outward translation of the injection piston 20.

Furthermore, the injection assembly 10 comprises a main fluid inlet 28 and a shut-off valve 102 placed between the main inlet 28 and the main chamber 26 and suitable to prevent the return of fluid from the main chamber 26 to the main inlet 28.

For example, the shut-off valve 102 is made in accordance with the teaching contained in document EP-A1-2942127 in the name of the Applicant.

The machine 1 further comprises a first accumulator 30 (which may be loaded from a relative cylinder, for example containing pressurized nitrogen) for the movement circuit of the injection piston 20. The first accumulator 30 is connected upstream of the main inlet 28, and a proportional delivery valve 104 operates between the accumulator 30 and the main inlet 28.

The delivery valve 104 is controlled electronically and is feedback-driven by means of a position transducer 204 suitable to detect a signal as a function of the valve opening.

The main pressure chamber 26 is further connected to an injection drain 29 connected to the drain, along which an injection return drain valve 105 is operative.

The injection assembly 10 further comprises a main back-pressure chamber 32, downstream of the tail end 24 of the injection piston 20, connected to a return inlet 34 for the supply of pressurized fluid for the return translation of the injection piston 20.

The return inlet 34 is connected upstream to a pump delivery 36, upstream from which a hydraulic pump 38 is placed, typically actuated by an electric motor 39.

Preferably, the pump 38 of the injection assembly 10 also supplies the hydraulic circuit of the closing assembly 500.

An injection return valve 106 is arranged between the delivery pump 36 and the return inlet 34.

Moreover, in parallel on the pump delivery 36 and connected to the drain, a proportional pump maximum pressure valve 108 is arranged for regulating the pressure at the pump outlet 38.

In addition, the main back-pressure chamber 32 is connected to a return drain 40 connected to the drain, along which is arranged a proportional injection drain valve 112, which is controlled electronically and provided with a position transducer 212, suitable to emit a signal as a function of the opening of the valve.

Furthermore, the injection assembly 10 comprises a pressure multiplier device suitable to increase the pressure of the fluid contained in the main chamber 26, above the pressure supplied by the accumulator 30.

The multiplier device comprises a multiplier piston 42, which extends along a multiplication axis Y, for example, coinciding with the translation axis X of the injection piston 20, between a head end 44, suitable to operate in compression in the main chamber 30, and an opposite tail end 46.

The multiplier piston 42 is translatable on command along the multiplication axis Y.

The pressure multiplier device further comprises a secondary pressure chamber 48, upstream of the multiplier piston 42, and a secondary fluid inlet 50, upstream of the secondary chamber 100, for the inlet of pressurized fluid.

The machine 1 further comprises a second accumulator 52 (with relative refill cylinder) which is connectable to the secondary inlet 50, and a multiplier release valve 114 is placed between the second accumulator 52 and the secondary inlet 50.

The secondary pressure chamber 48 is also connected to a multiplier return drain 54 connected to the drain, along which is arranged a multiplier return drain valve 116.

Furthermore, the multiplier device comprises a secondary back-pressure chamber 56, downstream of the tail end 46 of the multiplier piston 42, connectable to the second accumulator 52 via a secondary return inlet 58.

Along the secondary return inlet 58, between the second accumulator 52 and the secondary back-pressure chamber 56, a main multiplier valve 118 is operative, which is proportional, electronically controllable and provided with a position transducer 218, suitable to emit a signal according to the opening of the valve.

Finally, a first auxiliary portion 60 connects the multiplier return drain valve 116 with the main multiplier valve 118 and is placed to drain, and a second portion 62 connects the multiplier return drain valve 116 with the injection return drain valve 105.

Furthermore, the injection assembly 10 comprises

- an injection piston position sensor 220, for example an encoder, for detecting the position of the injection piston 20;
- a main back-pressure chamber pressure transducer 232, to detect the pressure in the main back-pressure chamber 32;
- a main pressure chamber pressure transducer 226, to detect the pressure in the main pressure chamber 26;
- a secondary back-pressure chamber pressure transducer 256, to detect the pressure in the secondary back-pressure chamber 56.

A processing cycle provides for a step of closing the die by the closing assembly 500, a step of pouring the molten metal into the die by a pouring device (for example, comprising a robot), an injection step by the injection assembly 10, a die opening step by the closing assembly 500, and a step of recharging the oil in the accumulators by the hydraulic circuit of the injection assembly 10.

The injection step provides for a first sub-step, wherein the injection piston 20 advances at a reduced speed to allow the molten metal to fill the accessory channels provided in the die.

For the first sub-step, for a controlled partial opening of the delivery valve 104, the pressurized fluid is fed to the main inlet 28, for example at a nominal pressure of 150 bar, and from there to the main chamber 30 following the opening of the main shut-off valve 102.

By means of the controlled opening of the injection drain valve 112, the main back-pressure chamber 32 is discharged so that the action of the fluid in the main pressure chamber 30 and the opposite action of the fluid in the main back-pressure chamber 32 generate an outward thrust on the injection piston 20, at the speed desired.

Subsequently, preferably without interruption from the previous step, the method provides for a second sub-step, wherein the injection piston 20 advances at a higher speed than the forward speed of the first step.

For the second sub-step, for further controlled opening of the delivery valve 104, for example, total opening, the pressurized fluid is fed to the main inlet 28 at a greater flow rate and from there to the main pressure chamber 30 following the opening of the main shut-off valve 102.

Moreover, preferably, for the further controlled opening of the injection drain valve 112, the main back-pressure chamber 32 is discharged so that the action of the fluid in the main chamber 30 and the opposite action of the fluid in the main back-pressure chamber 32 generate an outward thrust on the injection piston 20, at the high speed desired.

Still subsequently, preferably without interruption from the previous sub-step, the injection step provides for a third sub-step, wherein the injection piston acts at almost zero speed but exerts on the molten metal an elevated thrust to force the molten metal, now in solidification, to offset the shrinkage suffered by cooling.

For the third sub-step, the pressure multiplier device is activated.

In particular, the pressurized fluid is fed to the secondary inlet 50 and from there to the secondary pressure chamber 48 following the controlled opening of the multiplier release valve 114. The secondary back-pressure chamber 56 is fed with pressurized fluid in a controlled manner through the main multiplier valve 118, so that the multiplier piston 42 exerts a thrust action on the fluid present in the main pressure chamber 30, increasing the pressure thereof, for example up to 500 bar.

As a result, the shut-off valve 102, sensitive to the pressure difference between the main inlet 40 and the main pressure chamber 30, passes into the closed configuration, fluidically separating the main inlet 40 and the main pressure chamber 30.

The fluid in the main pressure chamber 30, brought to a higher pressure, operates therefore on the injection piston 20, so that the piston exerts on the metal in the die the desired action to offset the shrinkage.

After completing the third sub-step, the multiplier device is deactivated; in particular, the multiplier piston 42 performs a return stroke by virtue of the pressurized fluid fed to the secondary back-pressure chamber 56 and the connection to the drain of the secondary pressure chamber 48 due to the opening of the multiplier return drain valve 116.

In addition, the injection piston 20 performs a return stroke by virtue of the pressurized fluid fed to the main back-pressure chamber 32 through the return inlet 34 and the delivery pump 36 by opening the injection return valve 106, and by the connection to the drain of the main pressure chamber 30 by opening the injection return drain valve 105.

The machine 1 further comprises a management device, comprising, for example, an electronic control unit or a programmable PLC or a microprocessor, operatively connected to the injection assembly and to the closing assembly for commanding them.

Moreover, the machine 1 is provided with an inverter 300 for controlling the electric motor 39, i.e. an electronic rectifier-inverter assembly, supplied with alternating current, suitable to vary the voltage and frequency of the alternating current output with respect to the input current, in order to modify the working parameters of the electric motor.

The inverter 300 is obviously connected to the electrical grid 302, preferably by means of a main switch 304.

The machine according to the present invention also comprises an evaluation system 400 for saving energy.

The evaluation system 400 comprises a delivery pressure sensor 402, i.e. a pressure transducer, connected to detect the pressure of the fluid at the delivery of the pump 38.

Moreover, the evaluation system 400 comprises an electronic processing device 404, comprising, for example, a programmable PLC or a microprocessor or an electronic control unit, for processing input signals.

The delivery pressure sensor 402 is operatively connected to the processing device 404 to supply a delivery pressure signal Spm thereto as a function of the pressure Pm at the delivery of the pump 38.

The evaluation system 400 further comprises an electronic consumption detection device 406 adapted to detect the instantaneous energy consumption of the motor 39.

The consumption detection device 406 comprises, for example, a multimeter suitable to detect the instantaneous energy consumed by the electric motor.

The consumption detection device 406 is operatively connected to the processing device 404 to send thereto a consumption signal Sc according to the energy consumed by the electric motor with inverter and operationally connected to the electrical grid 302, for example, upstream of the inverter 300 (and preferably downstream of the main switch 304), for the detection of the energy consumption of the machine with inverter.

The evaluation system 400 further comprises a storage device 408 wherein are stored consumption data relative to the power absorbed Pa by electric motors without inverter as a function of pressure values at the pump delivery.

The storage device comprises, for example, a hard disk or RAM memory or ROM memory.

The storage device 408 is operatively connected to the processing device 404 to make available to the processing device 404 the value of the instantaneous absorbed power Pa* relative to the power absorbed by a predefined electric motor without inverter according to a predefined pressure value at the delivery of the pump.

The evaluation system 400 further comprises a display device 410, for example, comprising a monitor or a display for displaying energy savings through a graphical interface.

Preferably, the user of the die-casting machine with inverter initially makes, directly or indirectly, the choice of a predefined electric motor without inverter, for example, corresponding to the electric motor without inverter of another die-casting machine available in the company. Consequently, for the storage device 408, a predefined electric motor without inverter remains selected.

For example, such initial choice is made indirectly by choosing a die-casting machine model which corresponds to a specific electric motor without inverter.

Once a desired processing operation has been set up, the die-casting machine with inverter performs the processing cycle according to the aforethe steps: closing the die, pouring the molten metal into the closed die, injecting the metal into the die, opening the die, and recharging the oil.

During the processing cycle, the processing device 404 acquires, preferably with continuity, the delivery pressure signal Spm, corresponding to a delivery pressure Pm, from the delivery pressure sensor 402 and the consumption signal Sc, corresponding to the consumed energy ΔEc, from the consumption detection device 406, referring to a predetermined time interval Δt.

Moreover, the processing device 404 acquires from the storage device 408 the data relating to the instantaneous absorbed power Pa* relative to the power absorbed by the electric motor without inverter selected previously, at the delivery pressure Pm, in the time interval Δt.

The processing device 404, according to the instantaneous absorbed power Pa*, calculates an estimated energy consumption ΔE* for the machine without inverter, in the interval Δt, according to the formula:

$$\Delta E^* = Pa^* \times \Delta t.$$

For a whole cycle or for each of the aforethe steps of the cycle or for sub-steps of one of the steps, the total estimated consumption E* is given by the sum of the current estimated consumption ΔE* in the time intervals At of the whole cycle or each step or each sub-step.

The processing device 404 provides to the display device 410 the data relative to the real energy consumption for the machine with inverter, relative to the entire cycle and/or to the individual steps and/or to the sub-steps, and the data relative to the estimated consumption of the machine without inverter, relative to the entire cycle and/or to the individual steps and/or to the sub-steps.

For example, preferably, the graphical interface represents, for the N-th cycle, the real consumption of the machine with inverter and the estimated consumption of the machine without inverter, for the entire cycle and/or for each step (for example, in the upper portion of the interface).

Advantageously, such representation allows an operator to evaluate whether the same processing may be performed on a machine without an inverter, possibly accepting a limited higher energy consumption.

Advantageously, moreover, such representation allows one to understand if all the steps of the processing cycle have been adequately calibrated or if there are steps for which the parameters may be improved, so as to achieve greater energy savings compared to a machine without inverter.

Moreover, preferably, the graphical interface represents, for the N cycles performed by the machine, the cycle time and the real energy consumption of the machine with inverter (for example, in the lower portion of the interface).

Advantageously, such representation allows the operator to understand if variations in the cycle time may lead to a benefit in terms of energy savings.

Figure 5:
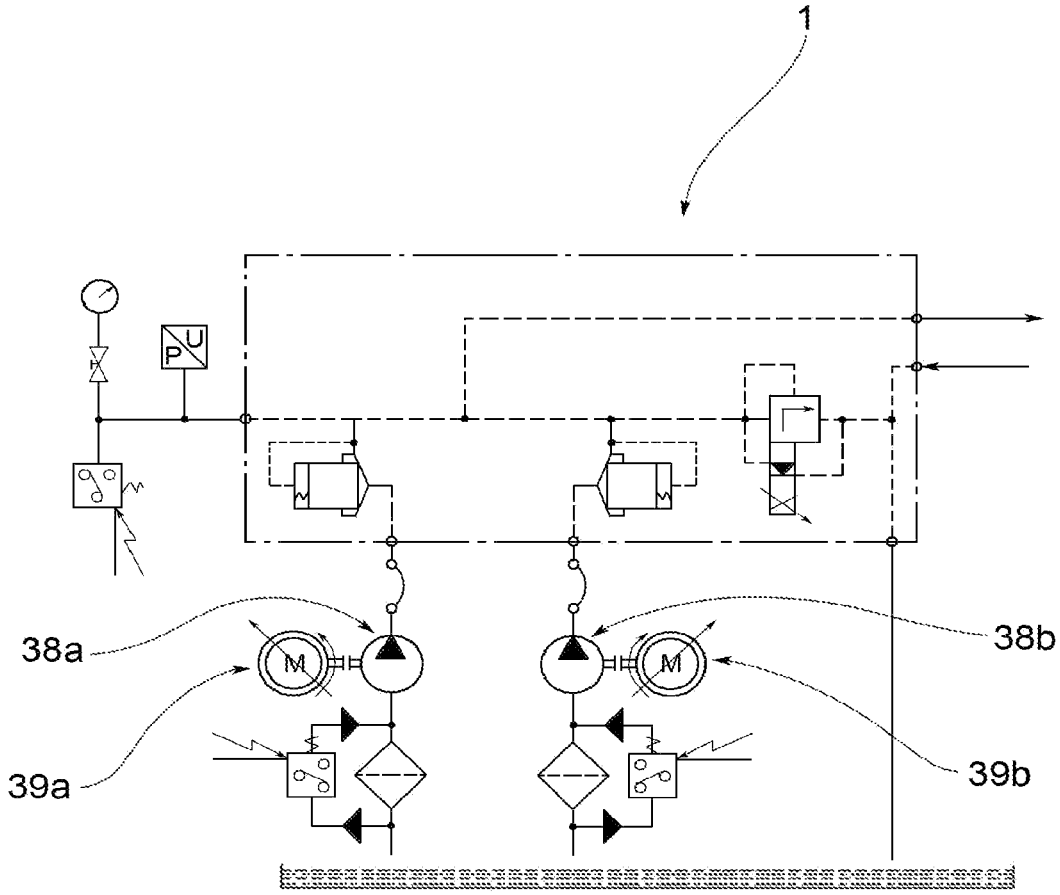
FIG. 5 illustrates a functional diagram of a die-casting machine according to a variant embodiment of the present invention.

According to a variant embodiment (FIG. 5), the machine 1 comprises several hydraulic pumps, for example two hydraulic pumps 38*a*, 38*b*, each actuated by a respective electric motor 39*a*, 39*b* controlled by a respective inverter.

Alternatively, the hydraulic pumps are actuated by a single electric motor controlled by an inverter.

According to a further embodiment, the hydraulic pumps 38*a*, 38*b* feed the hydraulic circuit of the closing assembly and the injection assembly and a single pressure transducer detects the pressure of the fluid at the delivery of the pumps 38*a*, 38*b*.

Alternatively, a first hydraulic pump 38*a* supplies the hydraulic circuit for the closing assembly and a second hydraulic pump 38*b* supplies a separate hydraulic circuit for the injection assembly.

Such variants and alternatives are also contained within the scope of the invention.

Innovatively, the die-casting machine according to the present invention allows the requirements referred to with reference to the prior art to be satisfied.

In particular, the energy saving evaluation system described above makes it possible to objectively evaluate the possibility of performing some processing operations on a machine without an inverter, rather than on a machine with an inverter.

What is claimed is:

1. A method for evaluating energy savings of a die-casting machine with an electric motor and an inverter compared to a chosen die-casting machine model having a predefined electric motor without inverter when performing a particular processing operation, the method comprising:

receiving selection of the chosen die-casting machine model having the predefined electric motor without inverter;

receiving a pump delivery pressure over a time interval detected by a delivery pressure sensor;

receiving energy consumption of the electric motor of the die-casting machine operatively connected to the inverter of the die-casting machine during the time interval detected by a consumption detection device;

obtaining an absorbed power of the predefined electric motor without inverter corresponding to the chosen die-casting machine model from a storage device; and calculating an estimated energy consumption over the time interval from the pump delivery pressure and the absorbed power of the chosen die-casting machine model having the predefined electric motor without inverter by a processing device operatively connected to the storage device; and comparing energy consumption of the die-casting machine with the inverter with the estimated energy consumption of the chosen die-casting machine model having the predefined electric motor without inverter for a processing cycle to obtain a difference in energy consumption;

if the difference in energy consumption is below a target value, determining that the die-casting machine does not need the inverter or if the difference in energy consumption is above the target value, determining that the die-casting machine is beneficial with inverter.

2. The method according to claim 1, further comprising displaying the energy consumption of the die-casting machine with inverter and estimated power consumption of the die-casting machine without inverter for the processing cycle.

3. The method according to claim 2, further comprising displaying the energy consumption of the die-casting machine with inverter and estimated power consumption of the die-casting machine without inverter for at least one step of the processing cycle and/or at least one sub-step of the at least one step.

4. The method according to claim 1, wherein the die-casting machine with the inverter comprises an additional motor and additional inverter and additional delivery pressure sensor and additional consumption detection device, wherein the calculating the estimated energy consumption over the time interval includes incorporating the delivery pressure from the additional delivery pressure sensor, and the absorbed power of a predefined additional electric motor without inverter and calculates an additional estimated energy consumption over the time interval.

5. The method according to claim 1, wherein the inverter is coupled downstream of a main switch that connects to an electric grid.

6. The method according to claim 1, further comprising:

providing an injection assembly provided with an injection piston for pressurizing cast metal poured into a die;

operatively connecting a hydraulic circuit to the injection piston for actuating the injection piston;

operatively connecting a hydraulic pump to the hydraulic circuit for feeding the hydraulic circuit through a delivery line;

operatively connecting an electric motor to the hydraulic pump for actuating the hydraulic pump; and operatively connecting an inverter to the electric motor for actuating the electric motor.

7. The method according to claim 6, further comprising:

operatively connecting a second hydraulic pump to the hydraulic circuit for feeding a second hydraulic circuit through a second delivery line;

operatively connecting a second electric motor to the second hydraulic pump for actuating the second hydraulic pump; and connecting a second inverter operatively to the second electric motor for actuating the second electric motor.

8. The method according to claim 1, further comprising coupling the consumption detection device to the processing device to the delivery pressure sensor to send a consumption signal according to the energy consumption of the electric motor with the inverter.

9. The method according to claim 1, wherein the processing device is configured to receive a selection of the chosen die-casting machine model.

10. The method according to claim 1, wherein the consumption detection device is coupled upstream of the inverter.

11. The method according to claim 1, further comprising operatively connecting the consumption detection device to an electric grid that is operatively connected to the inverter.

12. The method according to claim 11, wherein the consumption detection device is coupled to the electric grid that is coupled upstream of the inverter.

13. The method according to claim 1, further comprising varying the time of the processing cycle to determine if the die-casting machine with inverter increases energy saving.

* * * * *